US006098244A

United States Patent [19]

Conrad et al.

[11] Patent Number: 6,098,244

[45] Date of Patent: Aug. 8, 2000

[54] HANDLE FOR VACUUM CLEANER HAVING AN OFFSET HAND GRIP PORTION

[75] Inventors: Wayne Ernest Conrad, Hampton; Bradley Scott Logan-Hamilton, Bowmanville, both of Canada

[73] Assignee: Fantom Technologies Inc., Welland, Canada

[21] Appl. No.: 09/361,136

[22] Filed: Jul. 27, 1999

[51] Int. Cl.[7] ..... A47L 9/32

[52] U.S. Cl. ..... 15/410; 15/339

[58] Field of Search ..... 15/410, 339, 41.1, 15/98, 49.1

[56] References Cited

U.S. PATENT DOCUMENTS

| | | | |
|---|---|---|---|
| 187,618 | 2/1877 | Gore et al. | 15/41.1 |
| 3,671,991 | 6/1972 | Fukuba | 15/41.1 |
| 4,955,106 | 9/1990 | Stein et al. | 15/410 |
| 5,564,160 | 10/1996 | Luebbering | 15/410 |
| 5,996,175 | 12/1999 | Fusco | 15/410 |

*Primary Examiner*—Theresa T. Snider

*Attorney, Agent, or Firm*—Philip C. Mendes da Costa Bereskin & Parr

[57] ABSTRACT

A vacuum cleaner handle is provided which offers improved ergonomic characteristics by providing a grip portion which is offset from the center line axis of the cleaner head.

24 Claims, 3 Drawing Sheets

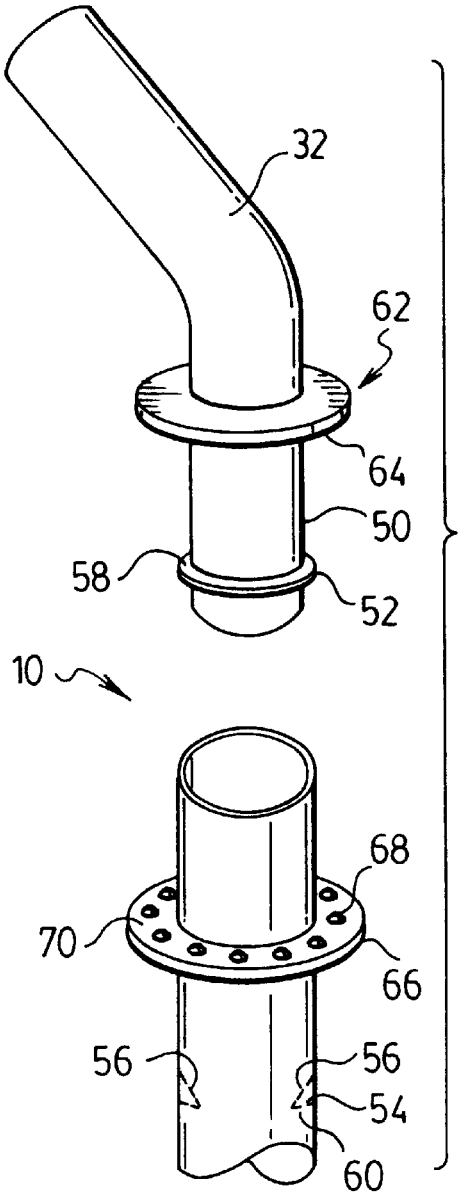
FIG.10.
FIG.11.
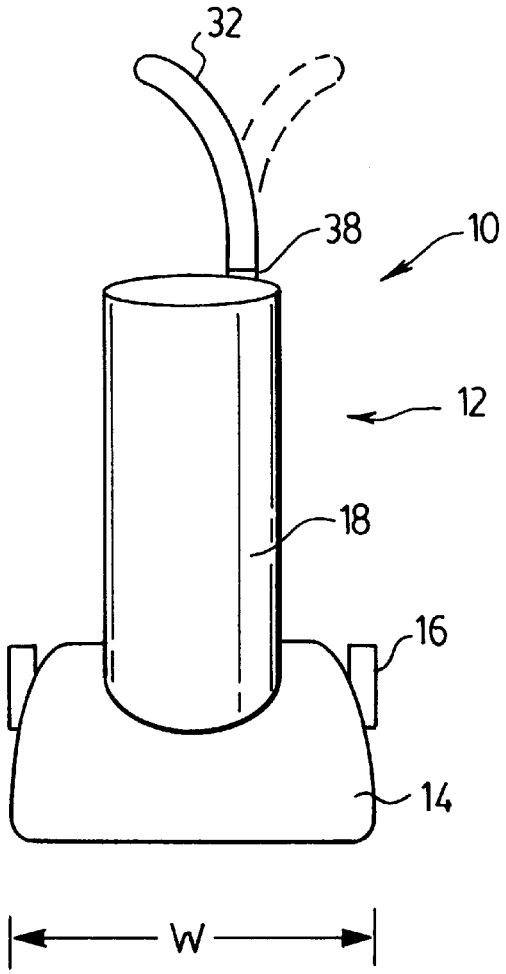

HANDLE FOR VACUUM CLEANER HAVING AN OFFSET HAND GRIP PORTION

FIELD OF THE INVENTION

The present invention relates generally to vacuum cleaners and, more particularly, to a handle for a vacuum cleaner.

BACKGROUND OF THE INVENTION

It has long been known to provide a vacuum cleaner with a moveable cleaning head for movement over a floor to clean the floor surface. For convenience of movement, an extended handle is attached to the cleaning head so that the user may stand more or less erect while moving the cleaner head over the floor.

In most standard cleaner head designs, the cleaner head is a planar member with wheels. The handle member is centrally mounted thereon and pivotally connected to the cleaner head. This arrangement is standard for all types of vacuum cleaner heads, including upright vacuum cleaners, canister vacuums and central vacuum cleaning systems. To use the cleaner head, the user holds the end of the handle in one hand and moves the cleaner head about the floor in front of the user by extending an arm outwardly to move the cleaner head away from the user's body, and then bringing their arm back to the user's side to move the cleaner head back towards the user.

The difficulty with centrally mounting the handle on the cleaner head is that, when the user brings their arm back to the user's side, eg., to clean the floor in front of the user's feet, a portion of the cleaner head is directly in front of the user's feet. This can make it difficult for the user to walk forward while cleaning the floor because the user is in danger of stepping on the cleaner head. Further, the interference between the user's feet and the cleaner head limits the amount of carpet which can be cleaned by the user in a single stroke.

In order to overcome this difficulty, the user could position the cleaner head to be displaced to one side of the user so that the cleaner head would contact a portion of the surface to be cleaned that is laterally displaced from the portion over which the user moved. The difficulty with this approach is that the user would have to extend their arm outwardly from their side to hold the handle of the vacuum cleaner. This is not an ergonomic position and can result in the user becoming tired before they have finished using the vacuum cleaner.

Accordingly, there is a need for an improved vacuum cleaner handle design providing enhanced ergonomic comfort and convenience for the user.

SUMMARY OF THE INVENTION

In accordance with the instant invention, the handle of a vacuum cleaner has a hand grip portion which is laterally displaced from the centre line of the vacuum cleaner. Thus the handle is positioned so that it my be easily grasped by the user. Surprisingly, not only does this positioning of the hand grip portion provide improved comfort for the user, but even with the hand grip portion displaced from the centre of the cleaner head, the user may still easily control the cleaner head to move in a straight line.

In accordance with the instant invention, there is provided vacuum cleaner comprising a longitudinally extending cleaner head having an upper surface, a lower surface, transversely spaced apart opposed sides and a longitudinally extending axis centrally positioned between the opposed sides, and a handle having an upper portion positioned to one side of the longitudinally extending axis, the handle drivingly connected to the cleaner head for moving the cleaner head in response to a force applied to the upper portion.

In one embodiment, the vacuum cleaner further comprises an upper casing rotatably attached to the cleaner head and the handle is attached to the upper casing.

In another embodiment, the handle is attached to the cleaner head.

In another embodiment, the upper portion is positioned adjacent one of the opposed sides.

In another embodiment, the handle has a portion which is mounted to the vacuum cleaner to one side of the longitudinally extending axis.

In another embodiment, the handle further comprises a lower portion which is mounted to the vacuum cleaner to one side of the longitudinally extending axis and a portion extending laterally between the lower portion and the upper portion of the handle.

In another embodiment, the cleaner head has a centre line plane substantially parallel to the longitudinally extending axis and the handle has a the lower portion which is mounted to the vacuum cleaner at a position adjacent the centre line plane, the handle having a portion extending laterally between the lower portion and the upper portion of the handle.

In another embodiment, the upper portion has a hand grip portion that is angled to extend rearwardly and laterally.

In another embodiment, the upper portion has a hand grip portion which is lockingly rotatably mounted to handle.

In another embodiment, the upper portion has a hand grip portion which is ergonomically configured so as to be positioned adjacent the side of a person when they are using the vacuum cleaner.

In accordance with another embodiment, of the instant invention, there is provided a vacuum cleaner comprising cleaner head means moveable over a surface in a direction of travel, the cleaner head means having a centre line plane substantially parallel to the direction of travel and perpendicular to the surface when the cleaner head is positioned on the surface, and handle means for moving the cleaner head in response to a force applied to the handle means, the handle means having a portion positioned to one side of the centre line plane.

In one embodiment, the vacuum cleaner further comprises an upper casing including means for separating entrained dirt from dirty air entering the vacuum cleaner and the handle means is attached to the upper casing.

In another embodiment, the handle means is attached to the cleaner head.

In another embodiment, the handle means has an upper portion which is positioned adjacent a lateral side of the vacuum cleaner.

In another embodiment, the handle has a lower portion which is mounted to the vacuum cleaner at a position spaced from the centre line plane. All of the handle means maybe spaced from the centre line plane.

In another embodiment, the handle means further comprises a lower portion which is mounted to the vacuum cleaner at a position spaced from the centre line plane and a portion extending laterally between the lower portion and the portion positioned to one side of the centre line plane.

In another embodiment, the handle means has a portion which extends laterally.

In another embodiment, the upper portion has a hand grip portion that is angled to extend rearwardly and laterally.

In another embodiment, the upper portion has a hand grip portion which is lockingly rotatably mounted to handle.

In another embodiment, the handle means is ergonomically configured so as to be positioned adjacent the side of a person when they are using the vacuum cleaner.

BRIEF DESCRIPTION OF THE DRAWINGS

For a better understanding of the present invention, and to show more clearly how it may be carried into effect, reference will now be made by way of example to the accompanying drawings of a preferred embodiment of the vacuum cleaner in which.

DETAILED DESCRIPTION OF THE PREFERRED EMBODIMENT

Figure 1:
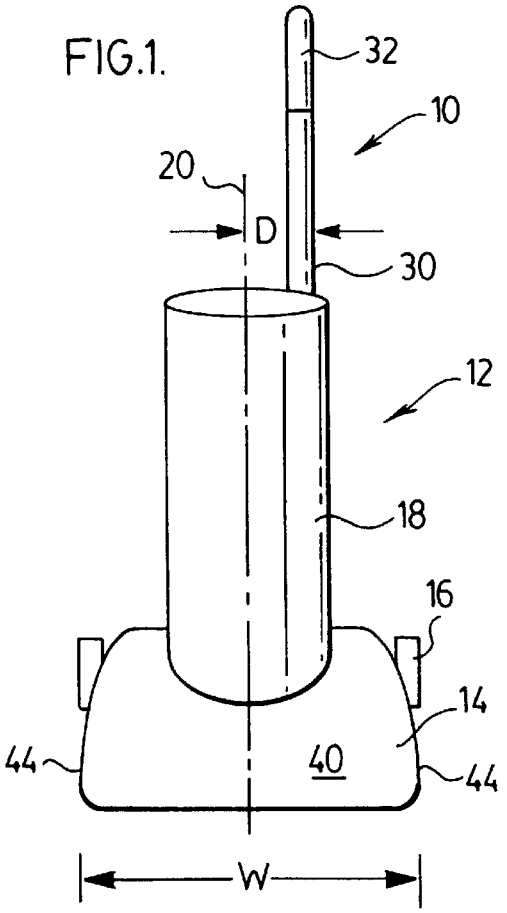
FIG. 1 is a front elevational view of an upright vacuum cleaner having an offset handle according to the present invention.

Referring to FIGS. 1–6, handle 10 according to the instant invention is shown is use with an upright vacuum cleaner 12. Upright vacuum cleaner 12 may be of any design know in the art. Accordingly, upright vacuum cleaner 12 may have a cleaner head 14, means for movably supporting cleaner head 14 on the floor (eg. wheels 16), and a main or upper casing 18. Cleaner head 14 and casing 18 house a dirty air inlet, a dust separation mechanism and motor of any type known in the art for use in vacuum cleaning devices.

Figure 7:
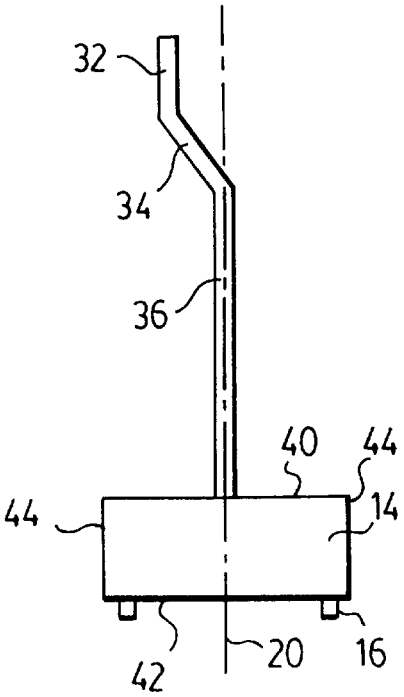
FIGS. 7–9 are rear elevational views of alternate embodiments of an upright vacuum cleaner according to the present invention wherein the handle is mounted to the cleaner head and, FIG. 10 is an exploded view of a handle according to another embodiment of the instant invention.
Figure 8:
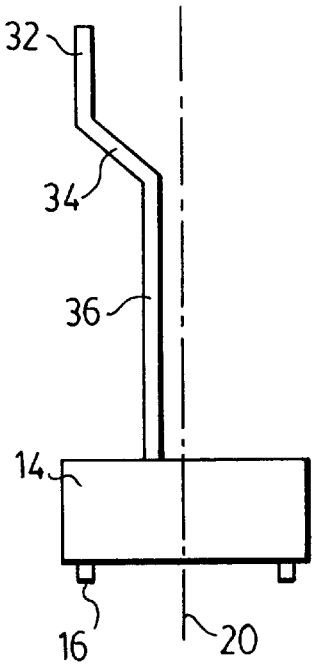
Figure 9:
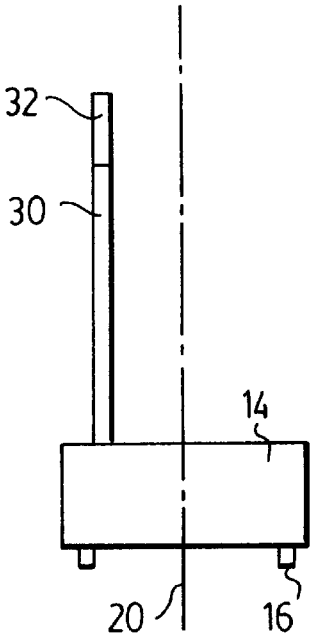

The handle of the instant invention may be used with any vacuum cleaner. For example, handle 10 may be used with a canister vacuum cleaner or a central vacuum cleaning system. In such appliances, the user moves a cleaner head across a surface (i.e. there is no upper casing pivotally mounted to the cleaner head). In such cases, handle 10 may be affixed to cleaner head 14 (see for example FIGS. 7–9).

Cleaner head 14 may be of any design known in the art. Cleaner head 14 has an upper surface 40, a lower surface 42 and transversely spaced apart opposed sides 44. In any design, cleaner head 14 has a longitudinally extending axis 22 centrally positioned within cleaner head 14 to thereby bisect cleaner head 14 (see FIG. 2) into two opposed lateral portions. Axis 22 extends in the direction of travel 22 of cleaner head 14. The vacuum cleaner has a centre line plane 20 which is substantially parallel to longitudinally extending axis 22.

According to the present invention handle 10 has an upper portion (eg. grip 32) positioned to one side of longitudinally extending axis 22. By positioning grip 32 towards one lateral side 44 of cleaner head 14, grip 32 may be positioned adjacent to the side of the user when they are using the vacuum cleaner. Accordingly, the user will not have to extend their hand outwardly from their side to control the vacuum cleaner when cleaner head 14 is positioned to the side of the user (i.e. outside the walking path of the user when they are using the vacuum cleaner). Handle 10 may be affixed to the vacuum cleaner (either upper casing 18 or cleaner head 14) by any means known in the art to drivingly connected to the cleaner head for moving the cleaner head in response to a force applied to the upper portion of the handle.

Figure 2:
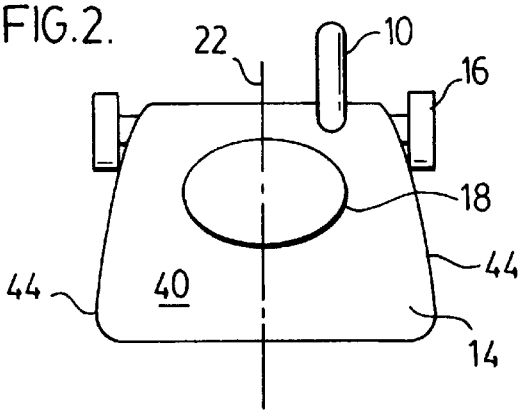
FIG. 2 is a top plan view of the upright vacuum cleaner of FIG. 1.
Figure 4:
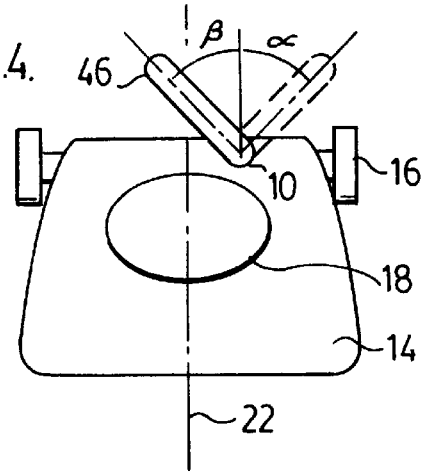
FIG. 4 is a top plan view of the upright vacuum cleaner of FIG. 1.

Referring to FIGS. 1 and 2, handle 10 has a shaft 30 and a grip 32. Shaft 30 is affixed to upper surface 40 of cleaner head 14 and is preferably pivotally mounted thereto. It will be appreciated that upper casing 18 may be supported by mounting it to shaft 30. In an alternate embodiment, it will be appreciated that shaft 30 may be affixed to upper casing 18 and upper casing 18 is pivotally mounted to cleaner head 14 (see FIGS. 5 and 6).

According to the present invention, grip 32 is offset laterally (i.e. in a direction perpendicular to the travel access) from longitudinally extending axis 22. The offset distance D may be any amount, but is preferably approximately equal to one half of the width W of cleaner head 14. This results in a reduction in the possibility of interference between a user's feet and cleaner head 14 during normal use.

Figure 5:
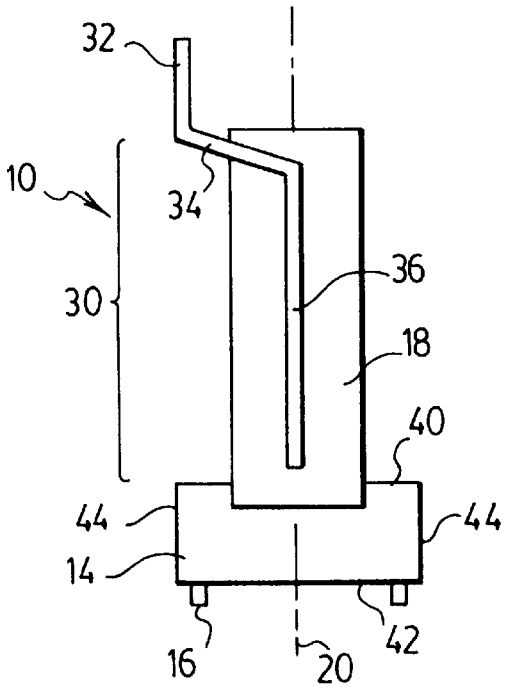
FIGS. 5 and 6 are rear elevational views of alternate embodiments of an upright vacuum cleaner according to the present invention wherein the handle is mounted to the upper casing of the vacuum cleaner.
Figure 6:
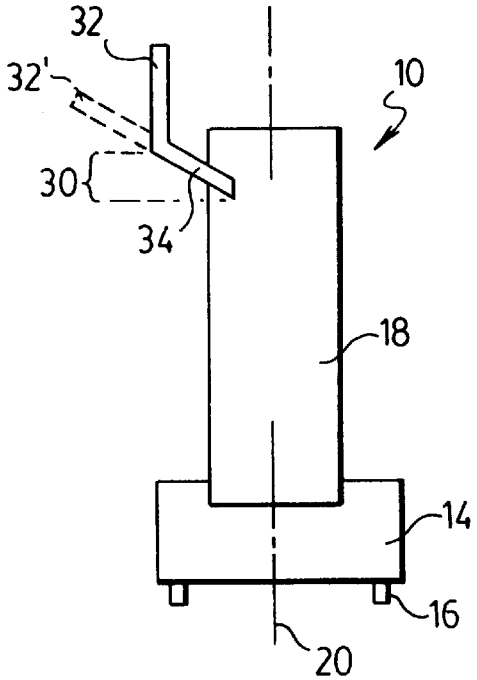

Although FIGS. 1 and 2 show shaft 30 substantially aligned with grip 32, it will be understood by one skilled in the art that the position of shaft 30 is not important to the present invention provided that handle 10 is mounted to the vacuum cleaner so that a user may move cleaner head 14 in response to a force applied by the user to handle 10. Thus, referring to FIGS. 1–4, shaft 30 may be a generally straight member and grip 32 may be positioned in line with shaft 30. This configuration may also be used if shaft 30 is connected directly to cleaner head 14 (see FIG. 9). Alternately, as shown in FIG. 5, shaft 30 may comprise angled portion 34 and lower portion 36. Lower portion 36 is affixed to main casing 18. Angled portion 34 extends laterally between lower portion 36 and grip 32 so that grip 32 of handle 10 is offset from centre line plane 20. Referring to FIG. 6, it will be appreciated that shaft 30 may consist only of angled portion 34. In this embodiment, angled portion 34 serves two purposes namely to provide a spacing means to offset grip 32 from centre line plane 20 and to affix handle 10 to upper casing 18. If handle 10 is affixed directly to cleaner head 14, shaft 30 may also have an angled portion 34 and a lower portion 36. Lower portion 36 may be positioned adjacent centre line plane 20 (see FIG. 7) or to one side of centre line plane 20 (see FIG. 8).

It will be appreciated that shaft 30 may be of any design known in the art. Angled portion 34 may extend at any angle from lower portion 36 or from upper casing 18 if angled portion 34 is directly mounted too upper casing 18. Thus, angled portion 34 may extend both laterally and rearwardly. Further, angled portion 34 may be curved.

It will be appreciated that grip 32 may be of any design known in the art. Grip 32 may extend at any angle from shaft 30. For example, grip 32 may extend rearwardly and upwardly from shaft 30 as is typical of the art (see for example FIGS. 1 and 2). It will be appreciated that grip 32 may itself also extend laterally (see for example FIG. 6 wherein grip 32' comprises an extension of angled portion 34). Further, grip 32 may be curved.

It will be appreciated that grip 32 may be positioned either to the right or to the left of axis 22 (when viewed from the rear of cleaner head 14). If cleaner head 14 is to be used by a right handed person, then grip 32 is preferably mounted to the left of axis 22. However, if cleaner head 14 is to be used by a left handed person, then grip 32 is preferably mounted to the right of axis 22 (when viewed from the rear).

Figure 3:
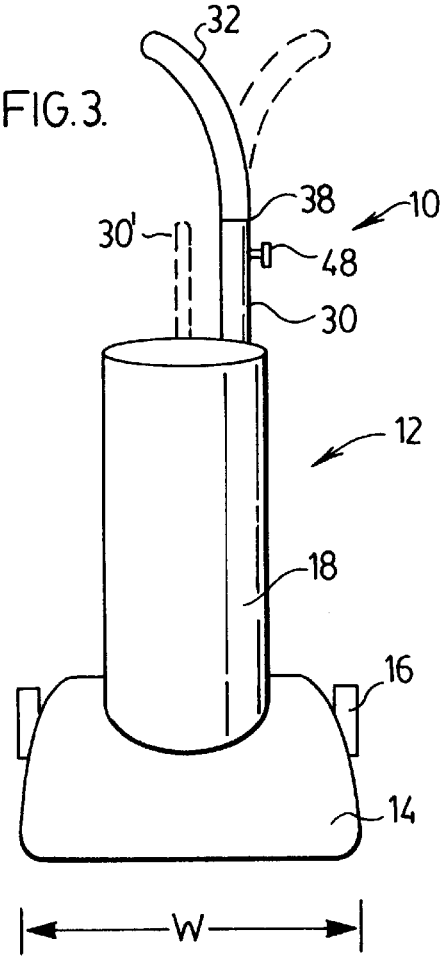
FIG. 3 is a front elevational view of an alternate embodiment of an upright vacuum cleaner according to the present invention wherein the handle has a rotatable hand grip.

In order to increase the flexibility of the vacuum cleaner, according to another aspect of the present invention, grip 32 is preferably rotatably mounted to shaft 30 such as at rotational point 38 (see FIG. 3). Any rotational mounting means known in the art may be used, such as a bearing or using a self lubricating nylon washer). Rotation point 38 permits grip 32 to be rotated around shaft 30 to a position which yields a comfortable hand orientation for the user. For a right-handed user using the vacuum cleaner, the angle of rotation $\alpha$ to a comfortable position is preferably about 10 to 50°, more preferably about 20 to 40° and most preferably the angle is about 30° clockwise from the straight back position (see the position in dotted outline in FIG. 4). It will also be appreciated that by rotating grip 32 in the counter-clockwise direction by an angle of rotation $\beta$ of preferably about 10 to 50°, more preferably about 20 to 40° and most preferably the angle is about 30° (as shown in solid outline in FIG. 4) the vacuum cleaner may be used by a left handed person. In this later case, a longer grip 32 may be used so that distal end 46 of grip 32 extends beyond centre line plane 20. To this end, grip 32 may be removably mounted to shaft 30 by any means known in the art.

Handle 10 may be provided with a locking means so that grip 32 may be locked at any desired angle of rotation. Any means for locking one member to another to prevent the rotation of one member with respect to the other may be used. For example, if grip 32 has a lower portion which is rotatably received in shaft 30, shaft 30 may be provided with a threaded opening for receiving butterfly set screw 48 for lockingly engaging the lower end of grip 32. Thus, the user may simply rotate butterfly set screw 48 to enable grip 32 to be rotated and, when grip 32 is in the desired position, then butterfly set screw 48 may be rotated to fix grip 32 at a desired angle of rotation.

Alternately, grip 32 may be rotatably mounted about shaft 30 through a plurality of preferred positions in which it may be locked, with respect to shaft 30, so that grip 32 is prevented from easily rotating out of the desired position during normal use. These preferred positions may be provided by any means known in the art, such as a retractable detent means, twist-locking means, or other position-holding means. For example, referring to FIG. 10, shaft 30 comprises a hollow cylindrical member for receiving lower end 50 of hand grip portion 32. Lower end 50 has an annular detent member 52 positioned thereon. The inner portion of shaft 30 is provided with an annular detent member 54 shown in dotted outline in FIG. 10. When hand grip 32 is inserted into shaft 30, annular detent member 52 cams along upper surface 56 of annular detent member 54 and extends through annular detent member 54 so that upper surface 58 of annular detent member 52 is positioned below lower surface 60 of annular detent member 54. The abutment of upper surface 58 against lower surface 60 maintains hand grip portion 32 within shaft 30 and allows it to freely rotate with respect to shaft 30. Hand grip 32 is provided with first engagement member 62 having a plurality of recesses (not shown) on lower surface 64 thereof. Shaft 30 is provided with second engagement member 66 having a plurality of detent members 68 on upper surface 70 thereof. Annular detent members 52, 54 maintain engagement members 62, 66 in contact and therefore cause detent members 68 to mate with a respective recess on lower surface 64. Detent members 68 define preset positions in which hand grip 32 may be locked.

The advantages of the rotatable grip portion can equally be realized on a conventional, centre-mounted handle as well. For example, in FIG. 3, shaft 30' may be centrally positioned and adapted for rotatably receiving grip 32.

Accordingly the offset handle according to the present invention provides an increased ergonomic convenience to the user in moving a cleaner head about the floor by minimizing interference between cleaner head 14 and the user's body. Also, according to the angled handle of the present invention, a more ergonomic handle position is provided.

While the above description constitutes the preferred embodiments, it will be appreciated that the present invention is susceptible to modification and change without departing from the fair meaning of the proper scope of the accompanying claims. Further, it will be appreciated that handle 10 may also be constructed to function as a cleaning wand as is known in the art.

What is claimed is:

1. A vacuum cleaner comprising:

(a) a longitudinally extending cleaner head having an upper surface, a lower surface, transversely spaced apart opposed sides, a longitudinally extending axis centrally positioned between the opposed sides, a dirty air inlet and an air flow path extending from the dirty air inlet to a source of suction;

(b) an upper casing rotatably attached to the cleaner head; and, (c) a handle having an upper portion and a first portion connected to the upper casing for moving the cleaner head in response to a force applied to the the handle by a user, wherein at least a portion of the handle is positioned to one side of the longitudinally extending axis.

2. The vacuum cleaner of claim 1 wherein at least a portion of the handle extends laterally such that at least the upper portion of the handle is positioned to one side of the longitudinally extending axis.

3. The vacuum cleaner of claim 2 wherein the upper portion is positioned adjacent one of the opposed sides.

4. The vacuum cleaner of claim 1 wherein the handle has a portion which is mounted to the the upper casing to one side of the longitudinally extending axis.

5. The vacuum cleaner of claim 1 wherein the handle further comprises a lower portion which is mounted to the upper casing to one side of the longitudinally extending axis and a portion extending laterally between the lower portion and the upper portion of the handle.

6. The vacuum cleaner of claim 1 wherein the cleaner head has a centre line plane substantially parallel to the longitudinally extending axis and the handle has a lower portion which is mounted to the the upper casing at a position adjacent the centre line plane, the handle having a portion extending laterally between the lower portion and the upper portion of the handle.

7. The vacuum cleaner of claim 1 wherein the upper portion has a hand grip portion that is angled to extend rearwardly and laterally.

8. The vacuum cleaner of claim 1 wherein the upper portion has a hand grip portion which is lockingly rotatably mounted to handle.

9. The vacuum cleaner of claim 1 wherein the upper portion has a hand grip portion which is ergonomically configured so as to be positioned adjacent the side of a person when they are using the vacuum cleaner.

10. A vacuum cleaner comprising:

(a) a longitudinally extending cleaner head having an upper surface, a lower surface, transversely spaced apart opposed sides, a longitudinally extending axis centrally positioned between the opposed sides, a dirty air inlet and an air flow path extending from the dirty air inlet to a source of suction; and, (b) a handle having a first portion that is attached to the cleaner head for moving the cleaner head in response to a force applied to the handle by a user and an upper portion, at least a portion of the handle extending laterally such that at least the upper portion of the handle is positioned to one side of the longitudinally extending axis.

11. The vacuum cleaner of claim 10 wherein the upper portion is positioned adjacent one of the opposed sides.

12. The vacuum cleaner of claim 10 wherein the handle has a portion which is mounted to the cleaner head to one side of the longitudinally extending axis.

13. The vacuum cleaner of claim 10 wherein the cleaner head has a centre line plane substantially parallel to the longitudinally extending axis and the handle has a lower portion which is mounted to the cleaner head at a position adjacent the centre line plane.

14. The vacuum cleaner of claim 10 wherein the upper portion has a hand grip portion that is angled to extend rearwardly and laterally.

15. The vacuum cleaner of claim 10 wherein the upper portion has a hand grip portion which is lockingly rotatably mounted to handle.

16. The vacuum cleaner of claim 10 wherein the upper portion has a hand grip portion which is ergonomically configured so as to be positioned adjacent the side of the user when they are using the vacuum cleaner.

17. A vacuum cleaner comprising:

(a) a longitudinally extending cleaner head having an upper surface, a lower surface, transversely spaced apart opposed sides, a longitudinally extending axis centrally positioned between the opposed sides, a dirty air inlet and an air flow path extending from the dirty air inlet to a source of suction;

(b) an upper casing rotatably attached to the cleaner head; and, (c) a handle having an upper portion and a first portion connected to at least one of the cleaner head and the upper casing for moving the vacuum cleaner in response to a force applied to the upper portion the handle by a user, at least a portion of the handle extends laterally such that at least the upper portion of the handle is positioned to one side of the longitudinally extending axis.

18. The vacuum cleaner of claim 17 wherein the upper portion is positioned adjacent one of the opposed sides.

19. The vacuum cleaner of claim 17 wherein the handle has a portion which is mounted to the one of the cleaner head and the upper casing to one side of the longitudinally extending axis.

20. The vacuum cleaner of claim 17 wherein the handle further comprises a lower portion which is mounted to the one of the cleaner head and the upper casing to one side of the longitudinally extending axis.

21. The vacuum cleaner of claim 17 wherein the cleaner head has a centre line plane substantially parallel to the longitudinally extending axis and the handle has a lower portion which is mounted to the one of the cleaner head and the upper casing at a position adjacent the centre line plane.

22. The vacuum cleaner of claim 17 wherein the upper portion has a hand grip portion that is angled to extend rearwardly and laterally.

23. The vacuum cleaner of claim 17 wherein the upper portion has a hand grip portion which is lockingly rotatably mounted to handle.

24. The vacuum cleaner of claim 17 wherein the upper portion has a hand grip portion which is ergonomically configured so as to be positioned adjacent the side of the user when they are using the vacuum cleaner.

* * * * *